US006787716B1

(12) United States Patent
Menche

(10) Patent No.: US 6,787,716 B1
(45) Date of Patent: Sep. 7, 2004

(54) MULTIPLE WAY SWITCH ASSEMBLY AND SWITCH MODULE

(75) Inventor: Edgar Menche, Lüdenscheid (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 0 days.

(21) Appl. No.: 10/774,776

(22) Filed: Feb. 9, 2004

Related U.S. Application Data

(63) Continuation of application No. PCT/EP02/11499, filed on Oct. 15, 2002.

(30) Foreign Application Priority Data

Oct. 18, 2001 (DE) ..... 101 51 603

(51) Int. Cl.[7] ..... H01H 25/04
(52) U.S. Cl. ..... 200/6 A; 200/5 R
(58) Field of Search ..... 200/4, 6 A, 17 R, 200/18, 332, 335, 5 R; 345/161; 463/38; 700/85

(56) References Cited

U.S. PATENT DOCUMENTS 4,181,827 A 1/1980 Diepeveen
5,468,924 A 11/1995 Naitou et al.
5,631,453 A 5/1997 Maeda
5,719,361 A 2/1998 Lee
6,084,189 A 7/2000 Menche
6,246,019 B1 * 6/2001 Nakamura et al. ..... 200/6 A
6,335,496 B1 1/2002 Miyashita
6,541,716 B2 * 4/2003 Gotoh ..... 200/6 A
6,603,459 B2 * 8/2003 Matsufusa et al. ..... 345/156
6,703,571 B2 * 3/2004 Nishimoto et al. ..... 200/6 A
2001/0013464 A1 8/2001 Takatsuki

* cited by examiner

*Primary Examiner*—Michael A. Friedhofer
(74) *Attorney, Agent, or Firm*—Brooks Kushman P.C.

(57) ABSTRACT

A multiple position switch assembly includes two or more switch modules. The switch modules are each suited as an individual switch module for use in a two-way switch assembly. Two switch modules of like kind but complementary to one another may be combined with one another such that the two combined switch modules form a four-way switch assembly. Each switch module includes control elements pivotally or movably connected to a base. Each of the control elements is associated with a switching element. In the four-way switch assembly, the control elements are arranged in an antiparallel arrangement and each can be alternately actuated by a common actuator. Upon being actuated, the control elements pivot or move to actuate the corresponding switching element. The actuator is movable along four actuating directions oriented in a cross-shaped manner with regard to one another.

41 Claims, 3 Drawing Sheets

MULTIPLE WAY SWITCH ASSEMBLY AND SWITCH MODULE

CROSS-REFERENCE TO RELATED APPLICATIONS

This is a continuation of International Application PCT/EP02/11499, published in German, with an international filing date of Oct. 15, 2002, which claims priority to DE 101 51 603.7 filed on Oct. 18, 2001.

BACKGROUND OF THE INVENTION

1. Field of the Invention

The present invention relates to a multiple position switch assembly having at least two switch modules. The present invention also relates to a switch module for use in a multiple position switch assembly.

2. Background Art

In many applications such as motor vehicle manufacture, multiple position switch assemblies operate movable components. Such switch assemblies have a multi-function operator control operate which is, for example, cap-shaped, and can be moved in multiple directions. In order to facilitate operation, it is preferable for each of the motion directions of the movable component to be associated with an analogous movement direction of the operator control.

Such switch assemblies are used in the form of two-position switch assemblies in which the operator control has two opposite directions of operation, for example in order to raise and lower a window. Alternatively, such switch assemblies are used in the form of four-position switch assemblies in which the operator control has two pairs of opposite directions of operation which cross one another, for example in order to perform the XY adjustment of a mirror or the adjustment of a vehicle seat.

U.S. Pat. No. 6,084,189 discloses a multiple position switch assembly having a dome-shaped switch mat associated with a base. During adjustment, the switching elements of the dome-shaped switch mat are affected by a common actuator connected with an operator control. The operator control is mounted to tilt about several axes.

Relatedly, U.S. Pat. No. 5,468,924 discloses a multiple position switch assembly which has four plunger-like control elements concentrically arranged in a base and held so that they can slide. The control elements can be adjusted by a common actuator that can be moved by a centrally arranged operator control. The operator control is mounted to tilt. The control elements act on the switching elements of a dome-shaped switch mat associated with the base.

Further, U.S. Pat. No. 5,631,453 discloses a multiple position switch assembly made in the form of a four-position rocker switch. Four lever-like control elements are mounted in a base so that they can pivot. The control elements cooperate with the switching elements of a dome-shaped switch mat. A common actuator which is actuated by an operator control that is mounted to tilt in several axes controls the control elements.

These known switch assemblies have the disadvantage that they use a comparatively large number of individual parts, some of which are complicated to produce, which have to be specially tailored to the application in every case, and which require relatively great effort to assemble. Moreover, all the above-mentioned multiple position switch assemblies have the problem of not being modular and thus the space requirements always have to be tailored to the maximum determined by the functionality.

Moreover, U.S. Pat. No. 5,719,361 discloses a switch module having a dome-shaped switch mat arranged in a base. The base has two control elements on it that are associated with the dome-shaped switch mat. The control elements can move in opposite directions and can be alternately controlled by an operator control that can move in opposite directions. However, it is not easy to produce a four-position switch assembly by adding another such switch module to the original switch module, at least not by adding an a switch module nearly identical to the original switch module.

U.S. Patent Application No. 2001/013464 discloses a switch module in which a base has an operator control mounted thereon. The operator control is adjustable in several directions and has associated control elements. Each control element cooperates with a switching element that is made in the form of an axially movable slide. Each slide has a control bevel that cooperates with a respective switching element. Such a switch module has the problem that its design is quite complex as always being aimed at the maximum functionality.

SUMMARY OF THE INVENTION

An object of the present invention is to provide a multiple position switch assembly which is compact and has as many prefabricated subassemblies as possible with each such subassembly being simple and versatile to produce. Another object of the present invention is to provide an easy-to-produce switch module which can advantageously be used as a prefabricated subassembly in a multiple position switch assembly in accordance with the present invention.

The multiple position switch assembly in accordance with the present invention includes at least two switch modules. Each switch module can be actuated by an actuator that can move in opposite directions. When considered individually, each switch module forms a two-position subassembly for a two-position switch assembly. However, the switch modules are designed in such a way as to be combined in order to form a four-position subassembly for a four-position switch assembly. An actuator common to the switch modules can actuate the switch modules. In order to be combined, the switch modules are of the same kind but are preferably designed to be complementary to one another. The common actuator can preferably be moved in four directions arranged in the form of a cross.

The switch modules each have at least two control elements which are preferably levers. The control elements are associated with one another in pairs by the common actuator and are arranged on a common base in an antiparallel arrangement. The actuator is movable in opposite directions, which subtend an angle (preferably 90°) with the longitudinal extension of the control elements. An associated operator control such as a knob or a button is coupled to the actuator. Preferably, the operator control is rigidly connected with the actuator.

Each control element has at least one associated switching element. The switching element may be contained in the switch module, may be detached from the switch module, or may be fastened to another part of the switch assembly containing the switch module.

The switching elements can be made in various ways such as in the form of elastic contact elements, corresponding to the elastic contact elements of a dome-shaped switch mat which cooperate with associated mating contacts on a circuit board, for example; in the form of prefabricated microswitches, spring switching contacts; but also in the form of switching elements working in a contactless manner, such as, e.g., light barriers, Hall generators, or similar things (in which case an additional (elastic) element might be required to produce the tactile properties and or the force component necessary for return to initial position).

The versatility of the switch module is made possible by the special design and arrangement of the control elements and the base. As indicated above, in addition to using the switch module for a two-position switch assembly with an actuator having an opposite direction of operation, it is also possible to use the switch module in combination with a second switch module of the same kind for a four-position switch assembly in which the actuator has four directions of operation arranged in a cross. For special uses, it is also possible to design the switch module in such a way that its directions of operation are other than the perpendicular pairs of opposite directions.

It is preferable for the switch module to be made of one or more different plastic materials—two, for example—using injection molding. In an especially advantageous embodiment of the present invention, the control elements are pivoting levers connected with the base through an axle connection.

In this embodiment of the articulated connection, it is also favorable for the control elements and the base to be produced in one and the same injection molding tool using a multi-component injection molding technique which involves injecting the control elements in bearing receptacles molded on the base. Suitable selection of the plastic materials, especially with regard to the relative shrinkage of the individual materials when they harden, keeps the axle that is molded onto the control element so that it is able to rotate in the associated bearing receptacle almost without play. Moreover, it is also possible to build other moving parts (in particular, a lever-like actuator) into the switch module by the multi-component injection molding technique. This makes it possible, at least to a large extent, to eliminate assembly work.

The multiple position switch assembly in accordance with the present invention having two switch modules, as well as the switch module according to the present invention, are explained in detail below using schematically presented sample embodiments.

DETAILED DESCRIPTION OF THE PREFERRED EMBODIMENT(S)

FIG. 1 illustrates an individual switch module 1 in accordance with the present invention. Switch module 1 has a single-piece base 1*a*. Base 1*a* can be imagined as being subdivided into three areas: first area I, second area II, and connection area III. First and second areas I, II are located where respective control elements 1*b* are located, and connection area III bridges first and second areas I, II.

First and second areas I, II, which are where control elements 1*b* are located, accept articulated connections 1*c*, as well as—preferably—receptacles 1*d* or fixing parts for the switching elements. It is preferable if the outer contour of base 1*a* essentially follows the projection of the respective control element 1*b* onto base 1*a* in these areas.

In the sample embodiment shown, articulated connection 1*c* is in the form of an axle connection. For this purpose, base 1*a* has molded bearing receptacles for control elements 1*b*. An alternative embodiment of the articulated connection would be a film hinge, for example. In such an embodiment it is expedient for control elements 1*b* to be connected with base 1*a*, preferably as a single piece.

In the sample embodiment shown, receptacles 1*d* are provided for switching elements, which are in the form of elastically movable contact elements. The switching elements can be part of the switch module.

In the sample embodiment shown, first and second areas I and II are connected by two bars 1*i*. However, an alternative plate-shaped connection is also conceivable.

Figure 1A:
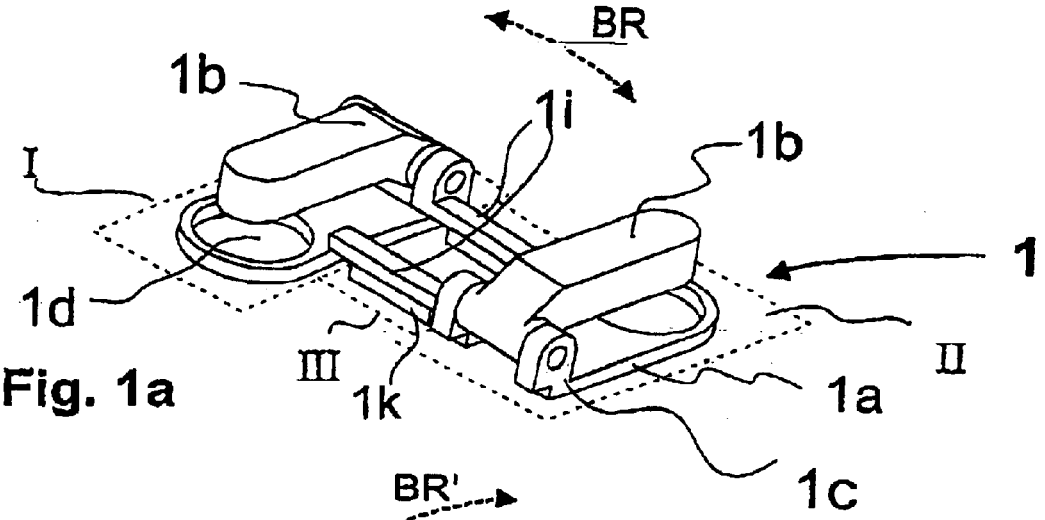
FIG. 1*a* illustrates a first switch module in accordance with the present invention.

In a two-position switch assembly the two control elements 1*b* of a (single) switch module 1 can be mechanically linked, for example with a T-shaped actuator mounted so that the actuator can pivot, forming a subassembly for a two-position switch assembly. FIG. 1*a* indicates the opposite directions of operation of the actuator or operator control (not shown here) as a dashed double-headed arrow labeled "BR".

Figure 1B:
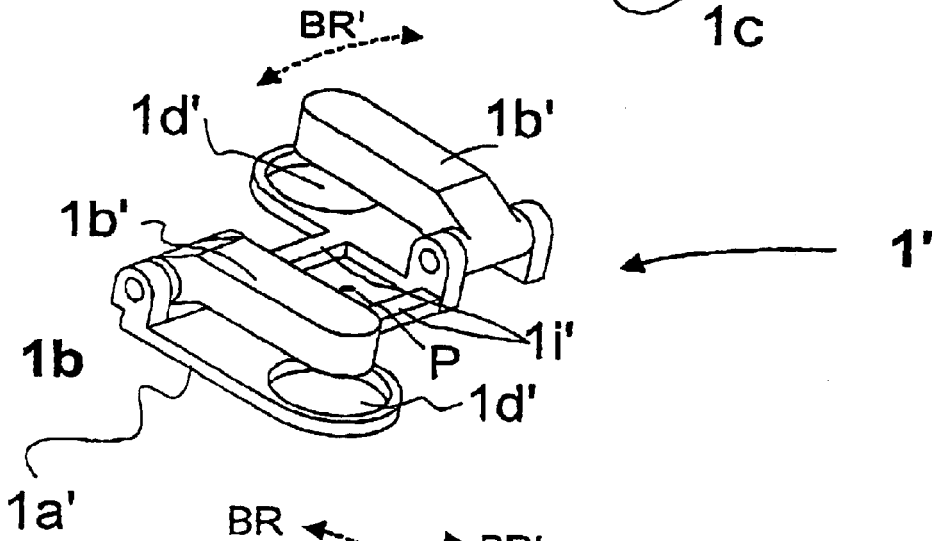
FIG. 1*b* illustrates a second switch module in accordance with the present invention in which the second switch module is identical to the first switch module but for being complementary to the first switch module.
Figure 1C:
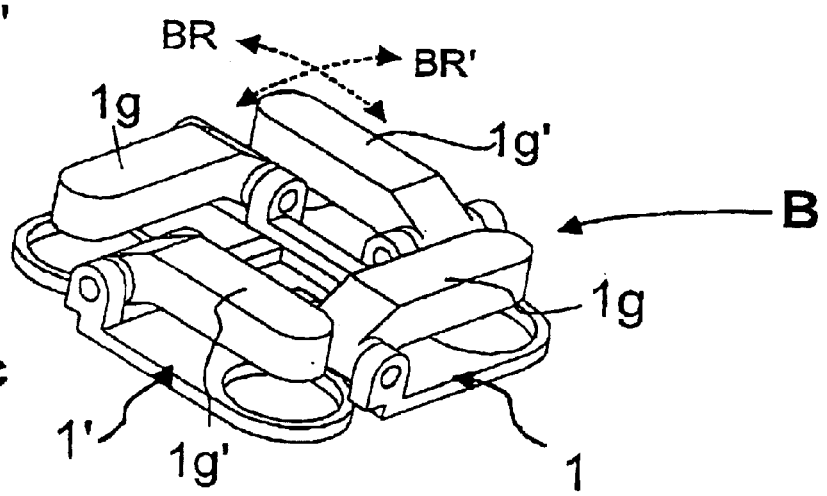
FIG. 1*c* illustrates the first and second switch modules combined into a four-position switch assembly in accordance with the present invention.

FIG. 1*c* illustrates the possibility of combining switch module 1 with a second switch module 1'. Second switch module 1' is the same kind as first switch module 1, but is complementary to the first switch module. In order to combine second switch module 1' with first switch module 1, the second switch module is put against base 1*a* in the connection area III.

FIG. 1*b* illustrates second switch module 1' which, as indicated above, is nearly identical to first switch module 1 but is complementary to the first switch module. The opposite directions of operation "BR'" of the actuator or operator control (not shown in FIG. 1*b*) are indicated as a dashed double-headed arrow. Both switch modules 1, 1' have a geometric shape with a point of symmetry P, relative to which they essentially have point symmetry when the respective base 1*a* is viewed from the top.

Switch modules 1, 1' are designed so that first switch module 1 combined with second switch module 1' rotated by about 90° forms a compact, four-position subassembly B for a four-position switch assembly. FIG. 1*c* illustrates the switch modules 1, 1' combined into a four-position subassembly (the associated, directions of operation BR, BR' of the actuator, which are arranged in a cross relative to one another, are drawn in as dashed double-headed arrows). It is preferable for the four-position subassembly B formed in this way to have an essentially square shape, with the four control elements (1*b*, 1*b*') being oriented along a specified direction of rotation.

The two switch modules 1, 1' shown in FIGS. 1*a*, 1*b* differ only in the design of the respective bases 1*a*, 1*a*' in the respective connection areas III. Preferably, this makes them complementary to one another so that combining switch modules 1, 1' produces a flat subassembly, in which control surfaces 1*g*, 1*g*' of control elements 1*b*, 1*b*' lie essentially in one plane and the base surfaces of bases 1*a*, 1*a*' lie essentially in one other plane.

To accomplish this, base 1*a*' is kept level in connection area III of second switch module 1', while base 1*a* in connection area III of first switch module 1 has an offset corresponding to the thickness of base 1*a*' in connection area III of the second switch module. To make the two switch modules 1 and 1' fit together when they are combined, connection bars 1*i* of base 1*a* additionally have fitting strips 1*k* on them.

Figure 1D:
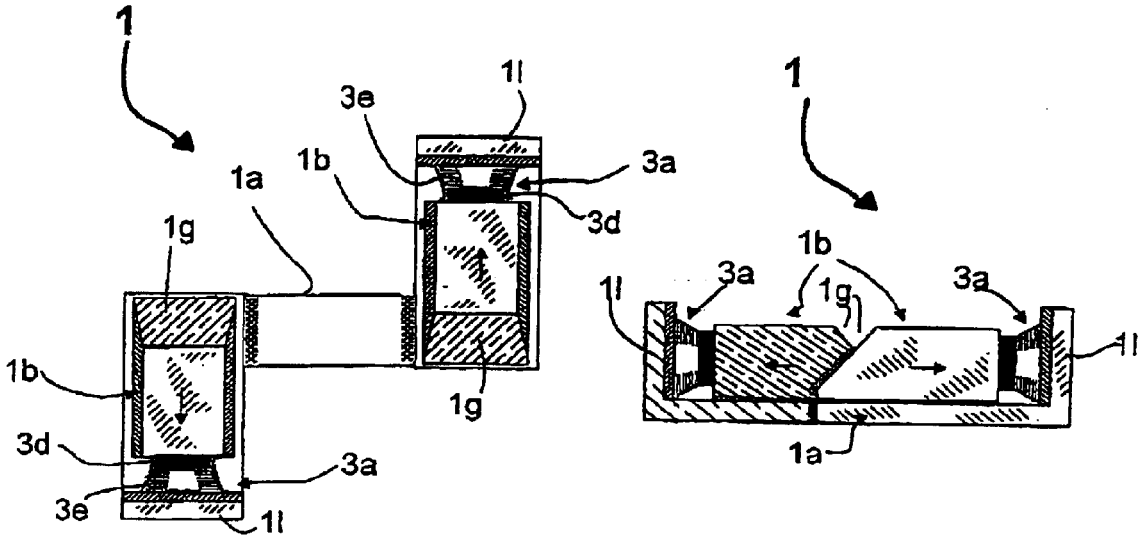
FIG. 1*d* illustrates top and side views of a switch module in accordance with an alternate embodiment of the present invention in which this switch module has two slide-like control elements.

In passing it should be noted that the design of first switch module 1 with lever-like control elements 1*b* does not in any way represent the only possible embodiment. For instance, FIG. 1*d* illustrates top and side views of a possible alternative design of first switch module 1. In this embodiment, control elements 1*b* are slides instead of levers, and are arranged so that they can slide axially on an essentially plate-shaped base 1*a*. Further, in this embodiment, slides 1*b* extend parallel to one another in the longitudinal direction, with the slides alternately acting on switching elements 3*a* which are arranged so that their direction of operation is horizontal.

In this sample embodiment switching elements 3*a* are realized by the contact elements of a dome-shaped switch mat and are arranged on extensions 1*l* of base 1*a* that are bent vertically upward. It is possible to identify the moving (switching) contact 3*d* (in particular a "dot"), which is held by a cone-shaped, elastic hollow body 3*e*, made, in particular, of silicone. Pressing on the switching contact (see arrows in FIG. 1*d*) brings switching contact 3*d* in contact with stationary contacts which are present (not shown in FIG. 1*d*) on extensions 1*l*. The slide-like control elements 1*b* are (corresponding to the embodiment described above) controlled by an actuator 2 (not shown in FIG. 1*d*) which can move in two opposite directions of operation. In turn, actuator 2 is preferably perpendicular to the longitudinal extension of the slides 1*b*.

In particular, actuator 2 can be made in the form of a pivoting lever, whose axis of rotation runs parallel to the longitudinal extension of slides 1*b*. Each of slides 1*b* has a control surface 1*g* in the form of a control bevel; the bevels of the respective slides lie opposite one another. This makes it possible for actuator 2 to actuate slides 1*b*— and through them the switching elements 3*a*—alternately in the horizontal direction (i.e., parallel to the surface of base 1*a*) by applying vertical pressure to the control bevels 1*g*.

Figure 2:
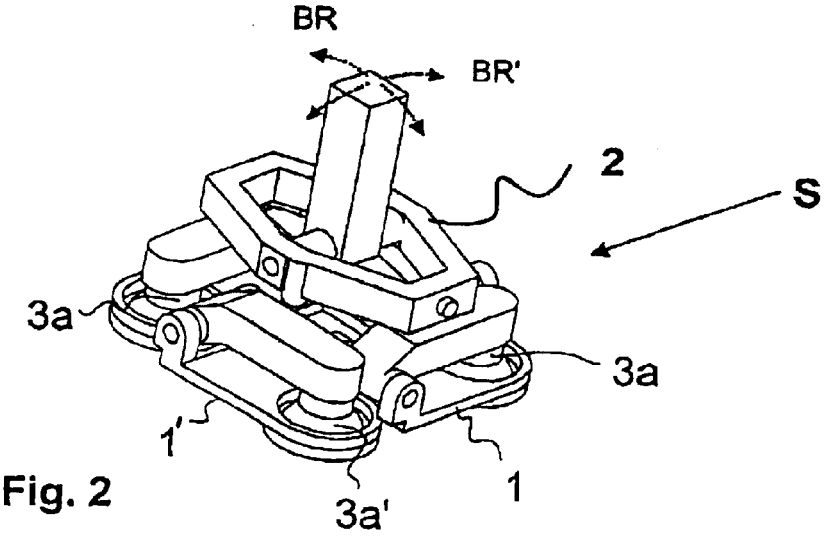
FIG. 2 illustrates the four-position switch assembly having an actuator and switching elements in accordance with the present invention.

FIG. 2 illustrates an assembled four-position switch assembly S with first and second switch modules 1, 1' according to the embodiment shown in FIGS. 1*a*, 1*b*, and 1*c* with a possible design for actuator 2. Actuator 2 is mounted in a kind of universal joint so that it can pivot on two perpendicular axes in four directions BR and BR'.

In the illustrated embodiment of the four-position switch assembly S, each of the four control elements 1*b*, 1*b*' is respectively associated with one of four individual switching elements 3*a*, 3*a*'. It is possible for switching elements 3*a*, 3*a*' to be fastened to respective bases 1*a*, 1*a*' and/or to respective control elements 1*b*, 1*b*' in a positive-locking manner or by joining together the materials of these parts.

It is also possible to build four-position switch assembly S with completely identical switch modules. If the switch modules are made similar to those shown in FIGS. 1 and 2 and if the complementary design of the intermediate area III is abandoned in order to standardize the switch modules, then control surfaces 1*g*, 1*g*' of control elements 1*b*, 1*b*' no longer lie in one plane, but rather are offset in height according to the material thickness of the intermediate area III. In order to keep this offset of control surfaces 1*g*, 1*g*' as small as possible, the thickness of the material in connection area III can be kept very thin and/or connection area III can be made elastic, so that the control elements or the surfaces of the base lie at least approximately in one plane. Alternatively, the offset can be compensated by a corresponding adaptation of the design of actuator 2 and/or of the switching elements 3*a*, 3*a*'.

Figure 3A:
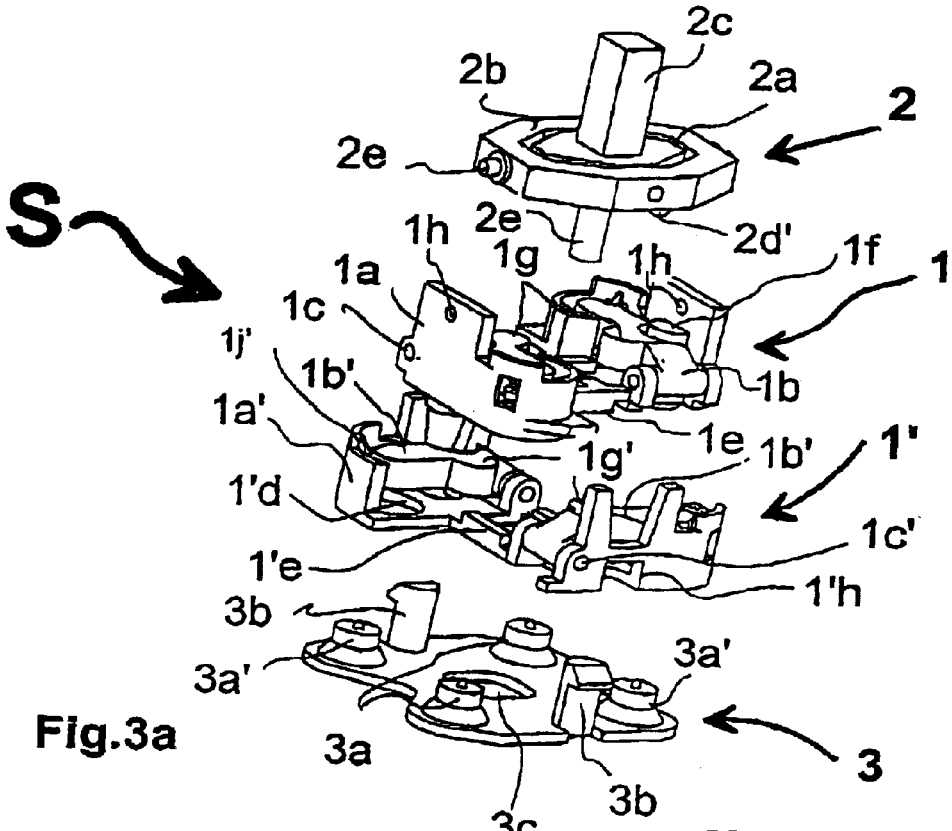
FIG. 3*a* illustrates an exploded view of a four-position switch assembly in accordance with an alternative embodiment of the present invention in which the switch assembly has two complementary switch modules.
Figure 3B:
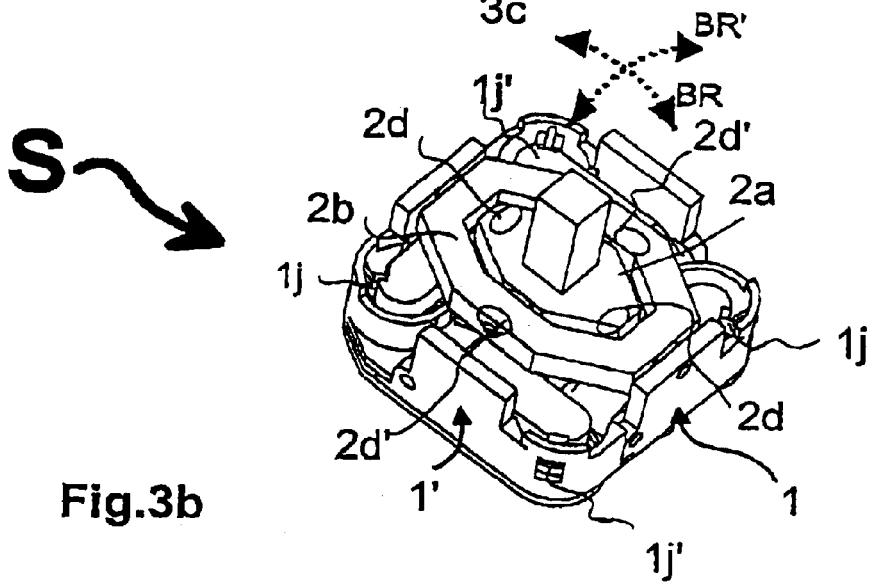
FIG. 3*b* illustrates an assembled view of the four-position switch assembly illustrated in FIG. 3*a*.

FIGS. 3*a* and 3*b* illustrate another sample embodiment of a four-position switch assembly S according to the present invention containing two complementary switch modules 1, 1'. In this four-position switch assembly S, the two complementary switch modules 1, 1' differ in design details adapted to the overall structure of the switch assembly, however the theoretical design of the switch modules is the same.

Each of switch modules 1, 1' in turn has two control elements 1*b*, 1*b*' that are arranged antiparallel to one another on the respective base 1*a*, 1*a*' and that are connected with them in an articulated manner. It is preferable if the articulated connections 1*c*, 1*c*' in turn are axle connections, with it being advantageous for the control elements 1*b*, 1*b*'—as already explained—to be injected in respective bases 1*a*, 1*a*' using a multi-component injection molding technique (in the same tool).

Actuator 2 of four-position switch assembly S can pivot on two perpendicular axes. Guide pin 2*c* fastened to actuator 2 can have an operator control (for example, a cap). Actuator 2 includes two internal and external control parts 2*a* and 2*b* which are movably connected with one another and which can also preferably be injected inside one another by multi-component injection molding. Actuator 2 itself is held by another axle connection so that it can rotate in switch module 1 with guide pin 2*c* being mounted in a universal joint. It is also preferable for this axle connection to be produced by multi-component injection molding so as to produce a subassembly having switch module 1 with actuator 2 movably mounted in the switch module.

Peripheral cams 2*d*, 2*d*' are on the bottom of control parts 2*a* and 2*b* (FIG. 3*a* illustrates only one of the four peripheral cams). Two peripheral cams 2*d* arranged opposite one another on the inside control part 2*a* cooperate with control surfaces 1*g* of control elements 1*b*, and the two peripheral cams 2*d*' arranged opposite one another on the external control part 2*b* cooperate with control surfaces 1*g*' of control elements 1*b*' (see also FIG. 3*b*). Also identifiable in FIG. 3*a* is a fastening element 1*f* formed on base 1*a*. This fastening element is in the form of a sleeve, for example, into which a self-threading screw can be screwed, fixing the four-position switch assembly S onto a support, for example.

Bases 1*a*, 1*a*' of switch modules 1, 1', respectively are, in connection area III, made complementary to each other according to the groove and spring principle in such a way that control surfaces 1*g*, 1*g*' of control elements 1*b*, 1*b*' lie essentially in a plane and the base surfaces of the base lie essentially in a (different) plane. In FIG. 3*a* the "groove/spring" fitting elements are labeled by reference numbers 1*e*, 1*e*'.

It is preferable for the switching elements 3*a*, 3*a*' associated with control elements 1*b*, 1*b*' to be designed as elastic contact elements embedded in a common molded part (the switch mat) that is elastic (e.g., made of silicone). Each contact element includes an elastic, approximately cone-shaped area, which contains an electrical contact, for example, a carbon dot or a contact made of an elastic, conductive composite material. This elastic moving contact can have pressure applied to it by the respective actuator, putting it in contact with the associated mating contact arranged on a circuit board, for example (not shown).

Switch mat 3 has a latching means 3*b* molded on it which cooperate with associated means of mating for the latch (latch receptacles) 1*h*', so that switch module 1' can be clipped onto switch mat 3 at specified positions.

Also identifiable in FIG. 3*b* are stop elements 1*j*, 1*j*' for control elements 1*b*, 1*b*'. Stop elements 1*j*, 1*j*' ensure that when the one control element 1*b* arranged on base 1*a* is actuated, the other control element 1*b* is pressed by the associated (elastic) switching element 3*a* against the corresponding stop 1*j*, preventing rattling of the control element 1*b* that has been released.

Together with the inherent mechanical properties of an elastic contact element, which produces a "clicking feeling", suitable selection of the lever ratios of the control elements 1*b*, 1*b*' (e.g., position of the center of pressure of peripheral cams 2*d*, 2*d*' on the lever-like control elements 1*b*, 1*b*') can give the multi-position switch assembly according to the present invention especially advantageous tactile properties.

Another advantage of this four-position switch assembly S is that it makes space-saving use of available space. In the center of four-position switch assembly S a useable free space is produced. In the sample embodiment shown in FIGS. 3*a* and 3*b*, an extension 2*e* of guide 2*c* passes through this free space. Thus, it is possible for extension 2*e* to be guided in a link guide (not shown), which is preferably cross-shaped, so that movement of actuator 2 is only possible along specified link paths.

The arrangement can also be designed so that extension 2*e* passes through switch mat 3 or an associated circuit board (not shown), so that it is also possible to take advantage of the space beneath the circuit board (for this purpose, FIG. 3*a* schematically shows an opening 3*c* in switch mat 3).

It is also conceivable for actuator 2 to have other (actuation) functions associated with it, for example extension 2*e* connected with guide pins 2*c* can be mounted so that it can rotate and/or move axially in control part 2*a*, so that it can execute an additional turning or pushing function. For this purpose, an axially movable extension 2*e* can be mechanically linked with a push-type switching element (e.g., a micro-switch) which is fastened to the internal control part 2*a* or on the circuit board. Accordingly, the rotation of an extension 2*e* mounted so that it can rotate can be converted into a corresponding electrical signal by a rotary potentiometer fastened to internal control part 2*c*. Moreover, it is possible for the rotational and or pushing motion of the operator control to be converted into a corresponding electrical signal by contactless signal transmitters and/or detectors (e.g., magnets and Hall generators).

Moreover, it is also possible to make advantageous use of the free space to hold illumination elements, for example light emitting diodes, etc. This makes it possible to transfer the state of switching elements 3*a*, 3*a*' into the operator control in an optical manner through light-conducting elements located in guide pins 2*c* and 2*e* (optical fibers), for purposes of display. It is also possible for internal control part 2*a* itself to be a light-conducting element.

While embodiments of present the invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

LIST OF REFERENCE NUMBERS

1, 1' Switch module
1*a*, 1*a*' Base
1*b*, 1*b*' Control elements
1*c*, 1*c*' Articulated connection
1*d*, 1*d*' Receptacles
1*e*, 1*e*' Groove/spring elements
1*f* Fastening element
1*g*, 1*g*' Control surfaces
1*h* Bearing receptacle
1*h*' Latch mating means
1*i*, 1*i*' Bars
1*j*, 1*j*' Stops
1*k* Fitting strip
1*l* Perpendicular extension
2 Actuator
2*a* Internal control part
2*b* External control part
2*c* Guide pins
2*d*, 2*d*' Peripheral cam
2*e* Extension
3 Switch mat
3*a*, 3*a*' Switching elements
3*b* Latching means
3*c* Opening
3*d* Switching contact
3*e* Elastic hollow body
B Four-position subassembly
S Four-position switch assembly
BR, BR' Opposite directions of operation of actuator or operator control
P Point of symmetry
I First area of base
II Second area of base
III Connection area of base

What is claimed is:

1. A multiple position switch assembly comprising:

first and second switch modules, each of the switch modules having a base and two control elements movably connected to the base, each of the switch modules further having two switching elements respectively associated with the control elements of the switch module; and an actuator associating the control elements of the first switch module with one another in a first pair and associating the control elements of the second switch module with one another in a second pair;

wherein the control elements and the base of each of the switch modules are operative to enable the first and second switch modules to be combined with one another to form a four position switch subassembly in response to the switch modules being interconnected to one another while being positioned against a connection area of the respective bases;

wherein in the four position switch subassembly the first pair of control elements of the first module are arranged to be actuated by the actuator in a first set of two opposite movement directions, and the second pair of control elements of the second module are arranged to be actuated by the actuator in a second set of two opposite movement directions, wherein the first and second sets of opposite movement directions are perpendicular to one another.

2. The assembly of claim 1 wherein:

the first and second switch modules are substantially identical.

3. The assembly of claim 1 wherein:

the control elements of the first and second switch modules have control surfaces;

wherein in the four position switch assembly the bases and the control elements of the switch modules are configured such that the control surfaces of the control elements lie in a first plane while the bases lie in a second plane.

4. The assembly of claim 3 wherein:

the connection areas of the bases of the first and second switch modules are complementary to one other.

5. The assembly of claim 1 wherein:

the control elements are levers pivotally connected to the respective bases through an articulated connection such that the control elements have an antiparallel orientation with the connections being parallel to longitudinal extensions of the control elements on one side, and perpendicular to the connections on an other side thereby forming a rectangular open space between the control elements;

wherein the bases each include a first area accepting the connection of one of the control elements of each pair of control elements, and a second area accepting the connection of the other one of the control elements of each pair of control elements, and the connection area which spans the first and second areas and lies within the open space.

6. The assembly of claim 5 wherein:

the first area and the second area of each of the respective bases accepts the switching elements associated with the respective control elements.

7. The assembly of claim 5 wherein:

the outer contours of the first and second areas follow projections of the control elements onto the respective bases.

8. The assembly of claim 5 wherein:

the connection areas of the bases are formed by connection bars.

9. The assembly of claim 5 wherein:

the bases have a relatively small material thickness in the connection areas such that in the four position switch assembly the bases lie in a plane.

10. The assembly of claim 1 wherein:

the connection areas of the bases overlap in the four position switch subassembly.

11. The assembly of claim 1 wherein:

the switch modules have symmetry about a point of symmetry in the four position switch subassembly.

12. The assembly of claim 1 wherein:

the switching elements are elastic contact elements of a switch mat.

13. The assembly of claim 12 wherein:

the switching elements are connected with at least one of free ends of the control elements and the base.

14. The assembly of claim 12 wherein:

the switch mat has latching means which cooperate with associated means of mating for a latch on one of the switch modules.

15. The assembly of claim 1 wherein:

the switching elements are microswitches.

16. The assembly of claim 1 wherein:

the switching elements are switch springs.

17. The assembly of claim 1 wherein:

one end of the control elements are movably connected with the respective bases through hinge joints in order for the control elements to pivot about the hinge joints.

18. The assembly of claim 1 wherein:

one end of the control elements are movably connected with the respective bases through axles in order for the control elements to rotate about rotational axes of the axles.

19. The assembly of claim 17 wherein:

one end of the control elements are movably connected with the respective bases through injection molding material.

20. The assembly of claim 1 wherein:

the control elements and the bases have stop elements which are arranged such that when one control element in a pair is actuated the other control element in the pair is pressed against the associated stop element by the switching element associated with the other control element.

21. The assembly of claim 1 wherein:

the actuator includes an internal control part which is movable on two perpendicular axes of rotation.

22. The assembly of claim 21 wherein:

the actuator further includes an external control part, wherein the internal control part is mounted in the external control part to be rotatable in the external control part.

23. The assembly of claim 21 wherein:

the internal control part has an extension which passes through an open space between the control elements.

24. The assembly of claim 23 wherein:

the extension is guided in an associated link guide along specified link paths that are oriented in the shape of a cross.

25. The assembly of claim 24 wherein:

the extension is mounted to move axially on the internal control part to actuate a pushing function.

26. The assembly of claim 25 wherein:

the extension has signal transmitters for converting the axial motion into electrical signals.

27. The assembly of claim 21 wherein:

the internal control part includes light conducting elements.

28. The assembly of claim 21 wherein:

the internal control part is a light-conducting element.

29. The assembly of claim 1 wherein:

the actuator is mounted to one of the switch modules in order to rotate in the switch module and thereby actuate the control elements in the movement directions when the first and second switch modules are combined to form the four position switch subassembly.

30. The assembly of claim 29 wherein:

the actuator is mounted to the switch module by a multi-component injection molding process.

31. The assembly of claim 1 further comprising:

the switching elements are connected to light sources for indicating the state of the switching elements.

32. The assembly of claim 1 wherein:

the actuator and the switch modules are produced in the same tool using a multi-component injection molding technique such that after the injection molding material hardens the actuator and the control elements are movably mounted in the subassembly.

33. A switch module for a multiple position switch assembly, the switch module comprising:

a base;

two control levers pivotally connected to the base;

two switching elements respectively associated with the control levers; and an actuator that is movable in opposite directions in order to alternately actuate the control levers such that the control levers pivot and actuate the switching elements upon being actuated by the actuator;

wherein the control levers are arranged on the base next to one another in an antiparallel orientation;

wherein the opposite directions of movement of the actuator subtend a specified angle with the longitudinal extension of the control levers.

34. The module of claim 33 wherein:

the specified angle is 90°.

35. The module of claim 33 wherein:

the control levers are pivotally connected with the base by an axle connection.

36. The module of claim 35 wherein:

the control levers are pivotally connected with the base through injection molding material.

37. The module of claim 33 wherein:

the switching elements are elastic contact elements of a switch mat.

38. A switch module for a multiple position switch assembly, the switch module comprising:

a base;

two control elements movably mounted to the base;

two switching elements respectively associated with the control elements; and an actuator that is movable in opposite directions in order to alternately actuate the control elements such that the control elements move and actuate the switching elements upon being actuated by the actuator;

wherein the control elements are axially movable slides having control bevels which actuate the switching elements upon the control elements being actuated by the actuator;

wherein the control elements are arranged on the base next to one another in an antiparallel orientation;

wherein the opposite directions of movement of the actuator subtend a specified angle with the longitudinal extension of the control elements.

39. The module of claim 38 wherein:

the specified angle is 90°.

40. The module of claim 38 wherein:

the control elements are movably mounted with the base through injection molding material.

41. The module of claim 38 wherein:

the switching elements are elastic contact elements of a switch mat.

* * * * *

UNITED STATES PATENT AND TRADEMARK OFFICE

CERTIFICATE OF CORRECTION

PATENT NO. : 6,787,716 B1
DATED : September 7, 2004
INVENTOR(S) : Edgar Menche

It is certified that error appears in the above-identified patent and that said Letters Patent is hereby corrected as shown below:

Column 10,
Line 15, delete "17" and insert -- 18 --.

Signed and Sealed this

Tenth Day of May, 2005

JON W. DUDAS
*Director of the United States Patent and Trademark Office*